US009176472B2

(12) United States Patent
Nakayama et al.

(10) Patent No.: US 9,176,472 B2
(45) Date of Patent: Nov. 3, 2015

(54) EXHAUST DEVICE AND IMAGE FORMING DEVICE INCLUDING SAME

(71) Applicant: KONICA MINOLTA, INC., Chiyoda-ku, Tokyo (JP)

(72) Inventors: Yusuke Nakayama, Toyokawa (JP); Naoki Kataoka, Toyokawa (JP); Hideji Hayashi, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/502,613

(22) Filed: Sep. 30, 2014

(65) Prior Publication Data

US 2015/0117894 A1 Apr. 30, 2015

(30) Foreign Application Priority Data

Oct. 24, 2013 (JP) ..... 2013-221594

(51) Int. Cl.
*F24F 7/007* (2006.01)
*F24F 13/08* (2006.01)
*G03G 21/20* (2006.01)

(52) U.S. Cl.
CPC ..... *G03G 21/206* (2013.01); *F24F 7/007* (2013.01); *F24F 13/08* (2013.01)

(58) Field of Classification Search
CPC combination set(s) only.
See application file for complete search history.

(56) References Cited

U.S. PATENT DOCUMENTS

2011/0200494 A1* 8/2011 Tanaka ..... 422/211

FOREIGN PATENT DOCUMENTS

| | | | | | |
|---|---|---|---|---|---|
| JP | 60169620 | A | | 9/1985 | |
| JP | 04242271 | A | | 8/1992 | |
| JP | H04-242271 | A | * | 8/1992 | ..... G03G 15/00 |
| JP | 2004045015 | A | | 2/2004 | |
| JP | 2011-164510 | A | * | 8/2011 | ..... G03G 15/00 |
| JP | 2011164510 | A | | 8/2011 | |

* cited by examiner

*Primary Examiner* — Clayton E Laballe
*Assistant Examiner* — Jas Sanghera
(74) *Attorney, Agent, or Firm* — Holtz, Holtz, Goodman & Chick PC

(57) ABSTRACT

An exhaust fan, an exhaust duct through which a discharged gas flows and a filter which is provided in the exhaust duct are included. A curved portion is provided in the exhaust duct, and the filter is provided on a downstream side in a direction of flow of the gas with respect to the curved portion. On an inside wall of the curved portion of the exhaust duct on an outer side in a radial direction, a first flow control member that uniformizes the amount of the gas flowing through the filter is provided so as to be perpendicular to the shaft of the curved portion, and a space is formed between the first flow control member and an inside wall of the curved portion on an inner side in the radial direction.

8 Claims, 5 Drawing Sheets

EXHAUST DEVICE AND IMAGE FORMING DEVICE INCLUDING SAME

This application is based on Japanese Patent Application No. 2013-221594 filed on Oct. 24, 2013 the contents of which are hereby incorporated by reference.

BACKGROUND OF THE INVENTION

1. Field of the Invention

The present invention relates to an exhaust device and an image forming device including such an exhaust device and more particularly relates to an exhaust device in which a curved portion is formed in an exhaust duct and an image forming device including such an exhaust device.

2. Description of the Related Art

In an image forming device using an electrophotographic system such as a facsimile, a printer or a copying machine, in order to reduce the discharge of substances (which may hereinafter be referred to as "unnecessary substances") such as odor, ozone and ultra-fine particles produced in the process of image formation out of the device main body, an exhaust device including a filter is provided.

An exhaust duct may be curved due to the reduction in the size of the exhaust device, restraints on the structure of the device main body or the like. When the curved portion is provided on an upstream side in a direction of flow of a gas with respect to the filter, the flow of the gas within the exhaust duct is disturbed to unbalance the amount of the gas flowing through the filter, with the result that the function of the filter may be insufficiently achieved.

Hence, in order to uniformize the flow of the gas into the filter, various types of technology have so far been proposed in which a flow control unit is provided on the upstream side of the filter (for example, Japanese Unexamined Patent Application Publication Nos. 2011-164510, 04-242271 and 60-169620).

SUMMARY OF THE INVENTION

It is highly required to further reduce unnecessary substances discharged from an image forming device due to the recent growing of office environmental awareness, and thus an object of the present invention is that in an exhaust device including a curved portion in an exhaust duct, gas is made to more uniformly flow into a filter.

According to the present invention, there is provided an exhaust device including: an exhaust fan; an exhaust duct through which a discharged gas flows; and a filter which is provided in the exhaust duct, where the exhaust duct includes a curved portion, the filter is provided on a downstream side in a direction of flow of the gas with respect to the curved portion, on an inside wall of the curved portion of the exhaust duct on an outer side in a radial direction, a plate-shaped first flow control member that uniformizes an amount of the gas flowing through the filter is provided so as to be perpendicular to a shaft of the curved portion and a space is formed between the first flow control member and an inside wall of the curved portion on an inner side in the radial direction.

Here, preferably, the first flow control member is formed with at least one pair of plate-shaped members, and the pair of plate-shaped members are provided in a shape of an inverted v that extends outwardly from a center of the curved portion in a direction of a shaft toward the downstream side in the direction of flow of the gas.

A second flow control member may be further provided on the inside wall of the curved portion on the inner side in the radial direction.

Preferably, the second flow control member is formed with at least one pair of plate-shaped members, and the pair of plate-shaped members are provided in a shape of an inverted v that extends outwardly from a center of the curved portion in a direction of a shaft toward the downstream side in the direction of flow of the gas.

Preferably, the shape of a cross section of the exhaust duct in a vertical direction with respect to the direction of flow of the gas is quadrangular.

Preferably, at least a part of the exhaust duct is removable with respect to a main body of the device.

Preferably, the filter is removable with respect to the exhaust duct.

Preferably, the filter collects minute particles.

According to the present invention, there is provided an image forming device including: the exhaust device described above, where the gas within the main body of the device is discharged to the outside.

DESCRIPTION OF PREFERRED EMBODIMENTS

Although an exhaust device and an image forming device according to the present invention will be described in more detail below with reference to accompanying drawings, the present invention is not limited to these embodiments.

Figure 1:
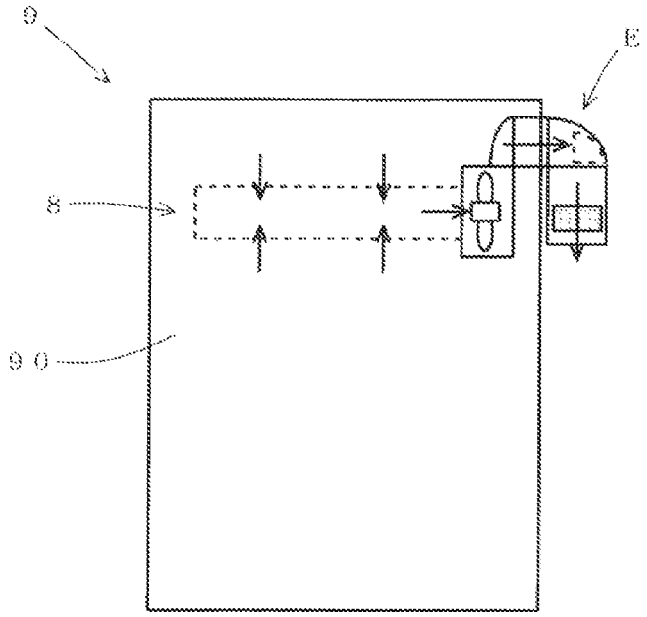
FIG. 1 A schematic view of an exhaust duct and an image forming device according to the present invention.

FIG. 1 shows a schematic diagram of the exhaust device E and the image forming device 9 according to the present invention when they are seen from the right side surface thereof. The image forming device 9 includes a discharge-reverse unit 8 of a sheet and the exhaust device E that discharges gas in a device main body 90 to the outside. The exhaust device E is connected to the discharge-reverse unit 8 of the sheet. The details of the exhaust device E will be described later.

Figure 2:
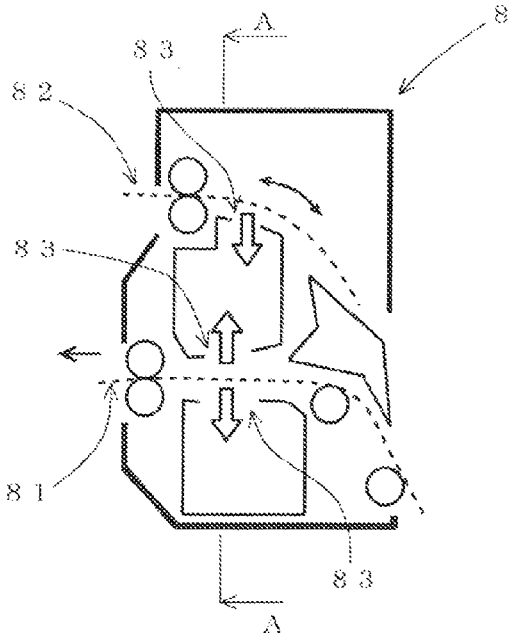
FIG. 2 A vertical cross-sectional view of a discharge-reverse unit.
Figure 3:
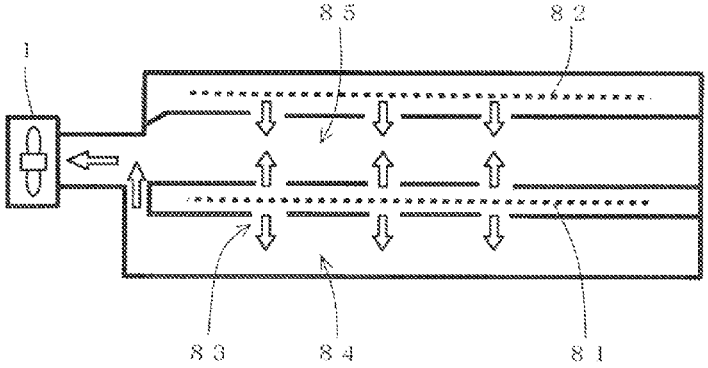
FIG. 3 A cross-sectional view taken along line A-A of FIG. 2.

FIG. 2 is a vertical cross-sectional view of the discharge-reverse unit 8, and FIG. 3 is a cross-sectional view taken along line A-A of FIG. 2. The discharge-reverse unit 8 includes a paper ejection path 81 and a reverse path 82. An inlet 83 is formed in each of the upper and lower surfaces of the paper ejection path 81 and the lower surface of the reverse path 82. As shown in FIG. 3, gas sucked from the inlets 83 is passed through gas flow paths 84 and 85 formed in the discharge-reverse unit 8 into the intake side of an exhaust fan 1.

The reason why the exhaust device E is connected to the discharge-reverse unit 8 as described above is, for example, that unnecessary substances such as odor produced from toner heated in a fixing unit (not shown) arranged on the upstream side of the discharge-reverse unit 8 in the direction of transport of the sheet are efficiently collected. The exhaust device E may naturally be connected to not only the discharge-reverse unit 8 but also the constituent members of the image forming device 9, such as a photosensitive member, an exposure device and the like, that produce unnecessary substances.

Figure 4:
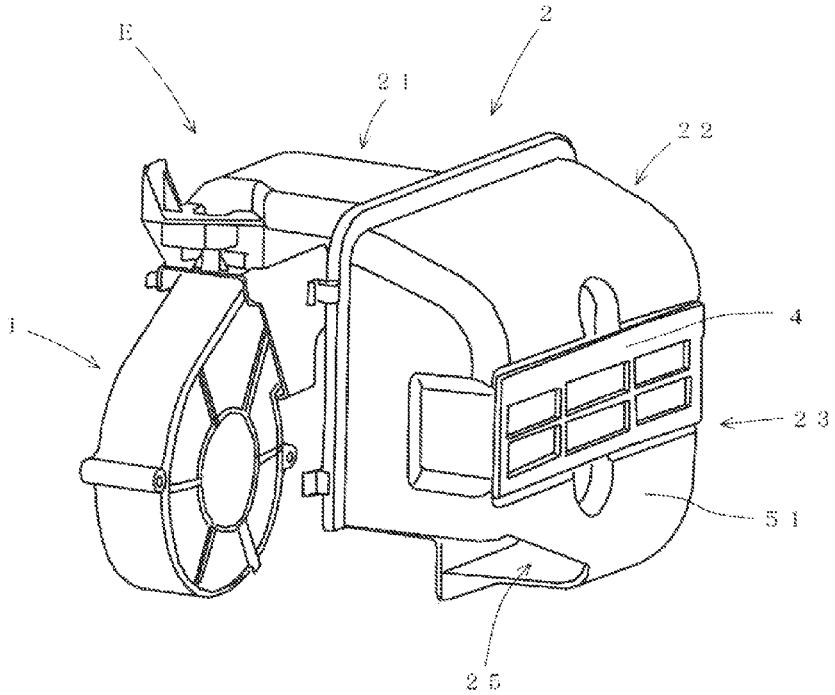
FIG. 4 An overall schematic view showing an example of the exhaust device according to the present invention.
Figure 5:
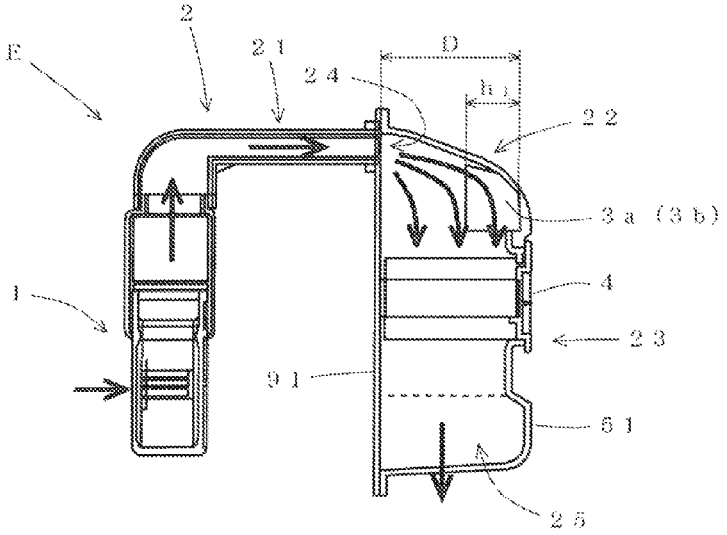
FIG. 5 A vertical cross-sectional view of the exhaust device.
Figure 6:
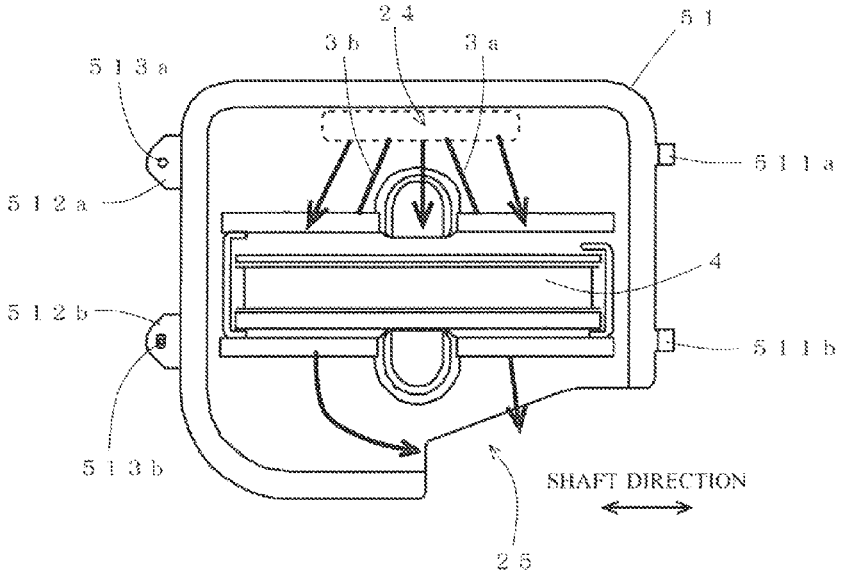
FIG. 6 A diagram of a cover of an exhaust duct in FIG. 5 when the cover is seen from the inside thereof.

FIG. 4 is an overall schematic view of the exhaust device E, FIG. 5 is a vertical cross-sectional view of the exhaust device E and FIG. 6 is a diagram of a cover 51 forming an exhaust duct 2 when the cover is seen from the inside thereof. The exhaust device E includes the exhaust fan 1 and the exhaust duct 2. As shown in FIG. 5, the exhaust fan 1 sucks gas in the direction of a shaft, and discharges it in a centrifugal direction. The exhaust duct 2 includes a connection portion to the exhaust fan 1, a horizontal portion 21, a curved portion 22, a vertical portion 23 and an outlet 25. The curved portion 22 and the vertical portion 23 are formed continuously and integrally with the cover 51 and the back surface side plate 91 of the device main body 90. On an inside wall of a portion forming the curved portion 22 of the cover 51 on an outer side in a radial direction, a pair of first flow control plates 3*a* and 3*b* are formed so as to be perpendicular to the shaft of the curved portion 22. One end side of the first flow control plates 3*a* and 3*b* is fixed to the inside wall on the outer side in the radial direction but the other end side is not in contact with an inside wall of the portion forming the curved portion 22 on the inner side, and thus a space is formed between the other end side and the inside wall on the inner side. As shown in FIG. 6, the pair of the first flow control plates 3*a* and 3*b* are provided in the shape of an inverted V that extends outwardly from the center of the curved portion 22 in the direction of the shaft (hereinafter also referred to as the "direction of a width") toward the downstream side in the direction of flow of the gas.

Figure 7:
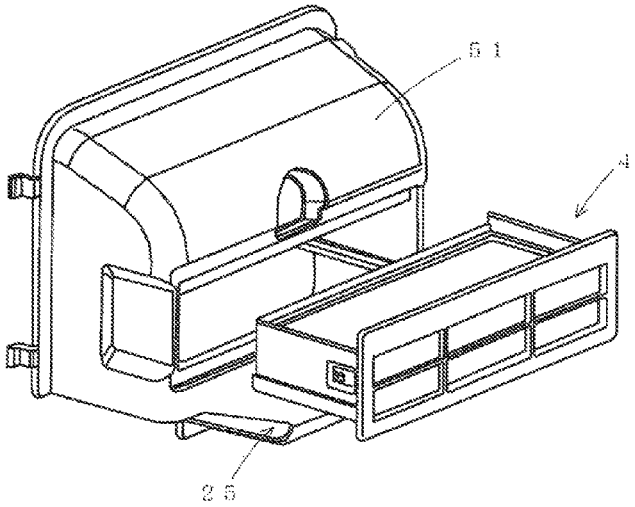
FIG. 7 A perspective view showing the removal and insertion of a filter with respect to the exhaust duct.

A filter 4 is removably provided in the cover 51. As shown in FIG. 7, the filter 4 is removable in a horizontal direction with respect to the cover 51, and the filter 4 is removed and inserted from and into the cover 5 such as when the filter 4 is replaced or when the filter 4 is maintained and checked.

The cover 51 is removably attached to the back surface side plate 91 of the device main body 90. Specifically, as shown in FIG. 6, on the side of the cover 51, nail portions 511*a* and 511*b* are formed a predetermined distance apart. On a side opposite the side on which the nail portions 511*a* and 511*b* are formed, protrusions 512*a* and 512*b* are formed a predetermined distance apart, and in the protrusions 512*a* and 512*b*, through-holes 513*a* and 513*b* are respectively formed. When the cover 51 is attached to the back surface side plate 91 of the device main body 90, the nail portions 511*a* and 511*b* of the cover 51 are first engaged with opening portions (not shown) formed in the back surface side plate 91 of the device main body 90. In this way, the cover 51 is located. Then, the entire side of the cover 51 is brought into intimate contact with the back surface side plate 91, and screws are inserted through the through-holes 513*a* and 513*b* formed in the protrusions 512*a* and 512*b* to screw the cover 51 to the back surface side plate 91.

As shown in FIGS. 4 and 5, the gas discharged obliquely upwardly from the outer circumference of the exhaust fan 1 flows through the horizontal portion 21 of the exhaust duct 2 and flows into the curved portion 22 through a connection port 24. Then, the direction of flow of the gas is changed from the horizontal direction to the downward direction by the curved portion 22, and thus the gas reaches the filter 4.

Figure 8A:
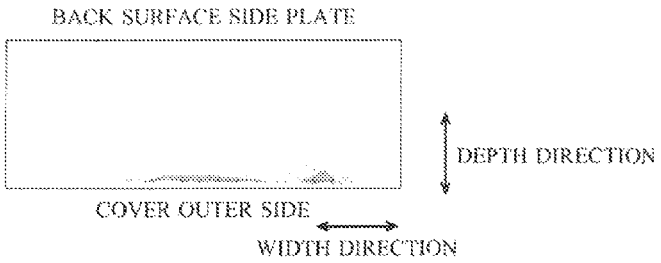
FIGS. 8A and 8B A diagram showing the distribution of the amount of flow of gas in the filter.
Figure 8B:
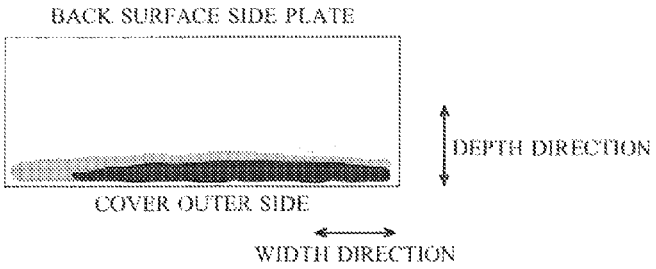

As shown in FIG. 5, in general, the amount of gas flowing when the direction of flow of the gas is changed from the horizontal direction to the downward direction by the curved portion 22 is larger on the outer side of the curved portion 22 in the radial direction than on the inner side. As shown in FIG. 6, the length of the connection port 24 in the direction of the width that is formed above the center of the curved portion 22 in the direction of the width is shorter than that of the curved portion 22 in the direction of the width, and thus the amount of gas flowing from the connection port 24 into the curved portion 22 is larger in the center portion in the direction of the width than in both end portions in the direction of the width. FIG. 8B shows the distribution of the amount of flow of the gas in the filter 4 when the first flow control plates 3*a* and 3*b* are not attached. In FIGS. 8A and 8B, in a darker-colored portion, a larger amount of gas flows. As described above, the amount of flow of the gas in the filter 4 provided on the downstream of the curved portion 22 significantly differs between the direction of the depth and the direction of the width.

Hence, in the present invention, as described above, the pair of the first flow control plates 3*a* and 3*b* are formed on the inside wall of the portion forming the curved portion 22 of the cover 51, and thus the amount of flow of the gas in the filter 4 is uniformized Specifically, as shown in FIGS. 5 and 6, the pair of the first flow control plates 3*a* and 3*b* are provided in the shape of an inverted V that extends outwardly from the center in the direction of the width toward the downstream side in the direction of flow of the gas. The one end side of the first flow control plates 3*a* and 3*b* is fixed to the inside wall of the portion forming the curved portion 22 on the outer side in the radial direction but the other end side is not brought into contact with the inside wall of the portion forming the curved portion 22 on the inner side, and thus the space is formed between the other end side and the inside wall on the inner side. In this configuration, the gas flowing from the connection port 24 into the curved portion 22 is also guided by the first flow control plates 3*a* and 3*b* from the center portion in the direction of the width to the outside in the direction of the width, and thus the gas is uniformly dispersed in the direction of the width. At the same time, the gas guided outwardly in the direction of the width by the first flow control plates 3*a* and 3*b* hits the inside wall of the cover 51 and bounces, a swirling current or the like is formed in the space between the first flow control plates 3*a* and 3*b* and the inside wall on the inner side and the amount of flow of the gas in the filter 4 is uniformized even in the direction of the depth. FIG. 8A shows the distribution of the amount of flow of the gas in the filter 4 when the first flow control plates 3*a* and 3*b* are attached. As is clear by comparison between FIGS. 8A and 8B, the device of the present invention in which the first flow control plates 3*a* and 3*b* are formed on the inside wall of the portion forming the curved portion 22 of the cover 51 more uniformizes the amount of flow of the gas in the filter 4.

Here, preferably, the height $h_1$ (shown in FIG. 5) in the direction of the depth of the first flow control plates 3*a* and 3*b* falls within a range of 30% to 50% of the width D (shown in FIG. 5) between the back surface side plate 91 and the cover 51. The height h of the first flow control plates 3*a* and 3*b* is made to fall within this range, and thus the amount of flow of the gas is more easily uniformized in the direction of the width and in the direction of the depth.

In the exhaust device of the present invention, the shape of the vertical cross section of the exhaust duct is not particularly limited, and may be formed in the shape of a quadrangle, a circle or an ellipse. However, when the shape of the vertical cross section of the exhaust duct is formed in the shape of a quadrangle, the effects of the present invention are easily achieved.

The filter used in the present invention is not particularly limited, and a conventionally known filter can be used. However, when the exhaust device of the present invention is used in an image forming device, a filter that collects minute particles produced within the device main body is preferably used.

Figure 9:
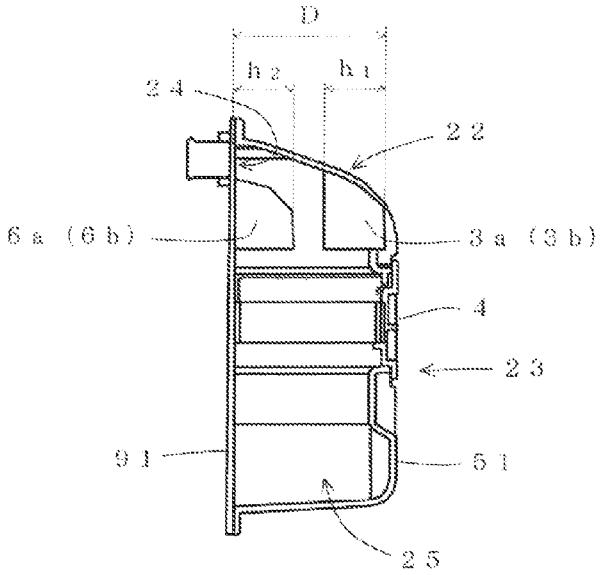
FIG. 9 A vertical cross-sectional view showing another embodiment of the exhaust device according to the present invention.
Figure 10:
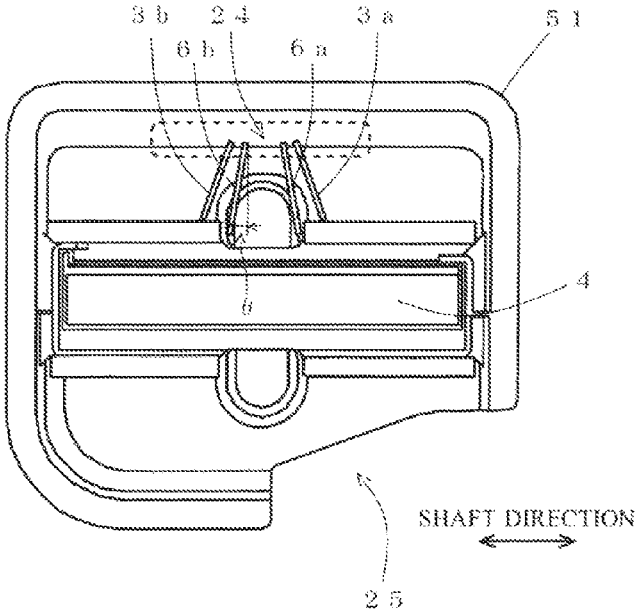
FIG. 10 A diagram of the cover forming the exhaust duct in FIG. 9 when the cover is seen from the inside thereof.

In FIGS. 9 and 10, another embodiment of the exhaust device E according to the present invention is shown. FIG. 9 is a vertical cross-sectional view of the curved portion 22 and the vertical portion 23 of the exhaust duct 2, and FIG. 10 is a diagram of the cover 51 forming the exhaust duct 2 when the cover is seen from the inside thereof. This exhaust duct 2 differs from the exhaust duct 2 of the embodiment (shown in FIGS. 5, 6 and like) described above in that in the curved portion 22, a pair of plat-shaped second flow control members 6*a* and 6*b* are further provided on the inside wall of the curved portion 22 on the inner side in the radial direction, that is, the back surface side plate 91. The second flow control members 6*a* and 6*b* described above are provided, and thus even when the amount of flow of the gas flowing within the exhaust duct 2 is large, it is possible to uniformize the amount of flow of the gas in the filter 4.

As shown in FIG. 10, the second flow control plates 6*a* and 6*b* are provided in the shape of an inverted V that extends outwardly from the center in the direction of the width toward the downstream side in the direction of flow of the gas. An inclination angle θ (shown in FIG. 10) of the second flow control plates 6*a* and 6*b* with respect to the vertical direction is preferably smaller than the inclination angle of the first flow control plates 3*a* and 3*b*. Moreover, preferably, the height $h_2$ (shown in FIG. 9) of the second flow control plates 6*a* and 6*b* from the back surface side plate 91 falls within a range of 30% to 50% of the width D between the back surface side plate 91 and the cover 51. Furthermore, preferably, the sum of the height $h_1$ of the first flow control plates 3*a* and 3*b* and the height $h_2$ of the second flow control plates 6*a* and 6*b* is smaller than the width D between the back surface side plate 91 and the cover 51.

Although in the embodiments described above, the connection port 24 is located in the center portion of the curved portion 22 in the direction of the width, the position and the size of the connection port 24 are not limited. For example, when the connection port 24 is formed in a position displaced to one side of the curved portion 22 in the direction of the width, in order to uniformize the amount of flow of the gas in the filter 4, the first flow control plates 3*a* and 3*b* are preferably formed in the position displaced to the one side in the direction of the width corresponding to the connection port 24.

What is claimed is:

1. An exhaust device comprising:

an exhaust fan;

an exhaust duct through which a discharged gas flows; and a filter which is provided in the exhaust duct, wherein:

the exhaust duct includes a curved portion, the filter is provided on a downstream side in a direction of flow of the gas with respect to the curved portion, on an inside wall of the curved portion of the exhaust duct on an outer side in a radial direction, a plate-shaped first flow control member that uniformizes an amount of the gas flowing through the filter is provided so as to be perpendicular to a shaft of the curved portion, a space is formed between the first flow control member and an inside wall of the curved portion on an inner side in the radial direction, and a second flow control member is further provided on the inside wall of the curved portion on the inner side in the radial direction.

2. The exhaust device of claim 1, wherein the first flow control member is formed with at least one pair of plate-shaped members, and the pair of plate-shaped members are provided in a shape of an inverted v that extends outwardly from a center of the curved portion in a direction of a shaft toward the downstream side in the direction of flow of the gas.

3. The exhaust device of claim 1, wherein the second flow control member is formed with at least one pair of plate-shaped members, and the pair of plate-shaped members are provided in a shape of an inverted v that extends outwardly from a center of the curved portion in a direction of a shaft toward the downstream side in the direction of flow of the gas.

4. The exhaust device of claim 1, wherein a shape of a cross section of the exhaust duct in a vertical direction with respect to the direction of flow of the gas is quadrangular.

5. The exhaust device of claim 1, wherein at least a part of the exhaust duct is removable with respect to a main body of a device to which the exhaust device is provided.

6. The exhaust device of claim 1, wherein the filter is removable with respect to the exhaust duct.

7. The exhaust device of claim 1, wherein the filter collects minute particles.

8. An image forming device comprising:

the exhaust device of claim 1, wherein the exhaust device is configured to discharge a gas within a main body of the image forming device to an outside of the image forming device.

* * * * *